US008635978B2

(12) United States Patent
Braun

(10) Patent No.: US 8,635,978 B2
(45) Date of Patent: Jan. 28, 2014

(54) ROTOR FOR A CAMSHAFT ADJUSTER AND CAMSHAFT ADJUSTER

(75) Inventor: Armin Braun, Buttenheim (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/702,184

(22) PCT Filed: May 31, 2011

(86) PCT No.: PCT/EP2011/058879

§ 371 (c)(1),
(2), (4) Date: Dec. 5, 2012

(87) PCT Pub. No.: WO2011/157542

PCT Pub. Date: Dec. 22, 2011

(65) Prior Publication Data

US 2013/0081585 A1 Apr. 4, 2013

(30) Foreign Application Priority Data

Jun. 17, 2010 (DE) ..... 10 2010 024 197

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS 7,878,164 B2 * 2/2011 Borraccia et al. ..... 123/90.17

FOREIGN PATENT DOCUMENTS

| | | |
|---|---|---|
| DE | 19980580 | 9/1999 |
| DE | 19834143 | 2/2000 |
| DE | 10356907 | 7/2005 |
| WO | 2006111217 | 10/2006 |
| WO | 2007088108 | 8/2007 |

* cited by examiner

*Primary Examiner* — Ching Chang
(74) *Attorney, Agent, or Firm* — Volpe and Koenig, P.C.

(57) ABSTRACT

A rotor (1, 21, 41) for a camshaft adjuster (61), having a rotor base body (3, 23, 43) and a number of rotor blades (5, 25, 45) extending radially outwards and located on the rotor base body (3, 23, 43), each of the blades having a blade end (7, 27, 47). To reduce leakage, the blade ends (7, 27, 47) of the rotor blades (5, 25, 45) take the form of sealing fins (9, 31, 49) that can be deformed radially outwards. A rotor (1, 21, 41) of this type affords the possibility of reducing leakage in a camshaft adjuster (61) using simple engineering and without added costs. The invention also relates to a camshaft adjuster (61) for an internal combustion engine, including a rotor (1, 21, 41) of this type.

8 Claims, 2 Drawing Sheets

ROTOR FOR A CAMSHAFT ADJUSTER AND CAMSHAFT ADJUSTER

FIELD OF THE INVENTION

The invention relates to a rotor for a camshaft adjuster with a rotor base body and also with a number of rotor vanes that are arranged on the rotor base body and extend radially outward. The invention further relates to a camshaft adjuster with such a rotor.

BACKGROUND

A rotor is used to support the targeted adjustment of the phase position between a camshaft and a crankshaft in an internal combustion engine. For this purpose, it is typically held as part of a camshaft adjuster in a stator that is locked in rotation with the crankshaft. In the installed state, the rotor is locked in rotation with the camshaft and can be adjusted relative to the stator, wherein a rotation of the camshaft can be achieved relative to the stator within a predetermined angular range. This makes it possible, for example, for the output of an internal combustion engine to be selectively increased or its fuel consumption to be reduced.

In the installed state, each of the vanes of a rotor divide up pressure chambers that are typically constructed in the stator into hydraulic areas that are charged with hydraulic fluid for controlling the camshaft adjuster. This produces gaps that are functionally dependent, in particular, on the contact point of the rotor vane and the lateral surface of the stator, wherein the hydraulic fluid can go from one hydraulic area into another in an uncontrolled manner. To reduce this undesired internal leakage, different concepts are known for sealing.

From WO 2007/088108 A1, a rotor of the type noted above is known that is used in a camshaft adjuster for an internal combustion engine. The rotor has a number of radially oriented vanes that form seals in the area of their end face relative to the inner lateral surface of the stator. For sealing the hydraulic areas that are separated from each other by the vanes, WO 2007/088108 A1 proposes the use of a separate sealing element. The sealing element is constructed with a U-shaped base cross section with a base leg oriented in the peripheral direction and two side legs oriented in the radial direction. The U-shaped base cross section can surround the entire end area of the end side of the rotor vane from the outside. Another variant provides that the vane has grooves on the end and the side legs of the separate sealing element engage in these grooves.

WO 2006/111217 A1 discloses a rotor as part of a device for the camshaft adjustment of an internal combustion engine, wherein this rotor is constructed as a rotor base body with a number of grooves. The rotor vanes are inserted into these grooves. A separate, so-called spring element is here arranged between the groove base and the rotor vane. This spring element, first, pushes the rotor vane radially outward and, second, forms a sealing contact on the groove base. The spring element acts the same way accordingly as a spring and sealing element and thus prevents the flow of hydraulic fluid between the hydraulic areas both between the vane end of the rotor vane and also in the groove base within the rotor base body.

From DE 199 805 80 T1, a vane rotor that is part of a valve timing control device for an internal combustion engine is also known. The vanes of the rotor are provided with a retaining groove cut in the axial direction on the end surface of the vane end. In this retaining groove, a separate sealing element can be fit that is in sliding contact with the inner peripheral surface of the stator. The sealing element is also held with a leaf spring in the retaining groove of the vane.

All of the constructions mentioned above for a rotor do provide a possibility for the reduction of the leakage within a camshaft adjuster, but separate sealing elements are disadvantageously associated with additional effort in terms of production and added costs.

SUMMARY

Accordingly, a first object of the invention is to disclose a rotor that is improved relative to the prior art and offers an option that does not add extra costs and can be implemented easily with respect to production for the reduction of the leakage in a camshaft adjuster.

A second object of the invention is to disclose a camshaft adjuster with such a rotor.

The first object of the invention is solved according to the invention by a rotor for a camshaft adjuster, with a rotor base body, and with a number of rotor vanes that are arranged on the rotor base body and extend radially outward and each of which has a vane end. Here it is provided that the vane ends of the rotor vanes are shaped into sealing webs that deform elastically outward in the radial direction for the reduction of leakage.

The invention starts from the knowledge that the internal leakage in a camshaft adjuster is caused by gaps that are too wide between the components adjacent to the hydraulic areas. To minimize this leakage, the gaps can be reduced such that a sufficient sealing effect of the hydraulic areas relative to each other is given during the operation of a camshaft adjuster. This can be achieved, for example, by narrower gap dimensions. However, high dimensional accuracy during the production of the components is required, in order to guarantee problem-free functioning of the camshaft adjuster. This can be achieved currently only with very high expense.

In front of this background, separate sealing elements for forming the seal are therefore used. Through such a configuration, the requirements on the dimensional accuracy during the production are indeed lower, but it is also associated with an increased cost factor and more complex installation, because the sealing elements must, first, be produced separately and installed in additional processing steps. Second, it is possible that the rotor must be modified, for example, for the use of a separate sealing element.

The invention solves these problems in a surprising way in that it eliminates the use of a separate sealing element. For this purpose, the vane ends of the rotor vane are shaped as such into sealing webs that can deform elastically outward in the radial direction for the reduction of the leakage. The sealing webs are part of the rotor vanes and, due to their elasticity during the operation of a camshaft adjuster, they fulfill the required sealing function that was previously implemented by separate sealing elements. By eliminating separate sealing elements, previously required processing steps for the rotor vanes can be eliminated, such as, for example, a formation of grooves for the positioning of the sealing elements.

The sealing effect of the rotor vanes involves, in particular, the centrifugal forces that are active during the operation of the internal combustion engine or the camshaft adjuster and act on a body in a rotating system. The centrifugal force is directed radially outward away from the axis of rotation and is dependent on the mass of the body and its distance from the axis of rotation.

Due to the rotation of the rotor in the installed state, a force directed radially outward acts on the vane ends and, in particular, on the sealing webs. The elastically deformable sealing webs are pressed radially outward against the inner wall of the stator, which reduces the radial leakage gaps between the vane ends and the inner lateral surface of the stator. In this way, a secure sealing effect can be achieved between the hydraulic areas within the camshaft adjuster.

In other words, due to their elastic construction, the vane ends or the sealing webs take over the sealing function within the camshaft adjuster, so that the use of separate sealing components can be completely eliminated.

The rotor can be constructed, for example, with an essentially circular base body. The number of rotor vanes arranged on the base body can be variable as a function of the adjustment angle to be set. As a basic condition it is applicable that the greater the number of rotor vanes on the rotor base body, the smaller is the adjustment angle that can be set. The rotor vanes can be attached to the rotor base body as separate components or preferably produced as one piece with this base body.

The rotor vanes extend in the radial direction, so that they contact the inner periphery or the inner lateral surface of a stator with their vane ends in the installed state. The vane ends extend in the peripheral direction advantageously with an outer radius corresponding to the inner radius of the stator, in order to prevent twisting of the vane ends on the inner lateral surface of the stator during operation. The functionality is guaranteed by the elastic deformability of the vane ends. Furthermore, one of the rotor vanes could be constructed with a locking borehole that is used in the installed state to lock with a stator, so that the stator and rotor can be held in an optimum position, especially for the start or idling of the internal combustion engine.

The sealing webs can have different basic constructions. The material thickness of the sealing webs is here, in particular, dependent on all of the component characteristics of the rotor or the rotor vanes. The dimensions of the sealing webs and the material have an effect on the elastic deformability of the sealing webs. The material can be selected accordingly, especially the forces that are active during operation, so that an adjustment of the resulting radial leakage gaps between the vane ends and the inner lateral surface of a stator is possible both in the standstill state and also during operation. The webs are constructed, in particular, by a targeted material weakening at the vane ends.

In one advantageous construction of the invention, material openings are formed in the vane ends for the construction of the sealing webs. The material openings are here advantageously bounded in the radial direction by the sealing webs. The material openings cause a weakening of the vane ends and produces the elastic deformability of the sealing webs. The material openings can be formed, for example, as cavities, recesses, or depressions in the rotor vanes. They are advantageously formed in the rotor vanes during the direct production of the rotor, for example, in a sintered or cast part, through the use of a corresponding mold, so that subsequent processing steps are not required. Furthermore, the elastic sealing webs can have a durable construction by matching the material openings with the material thicknesses, so that they can basically withstand the forces acting on them.

Preferably, the material openings are formed in the vane ends in the peripheral direction with a constant radial width. Thus, during operation, a constant sealing effect is realized across the periphery. Here, the highest sealing effect is achieved at the middle of the web, because the elastic deformation at this point is most strongly pronounced. The required stability of the vane ends is guaranteed by the strength of the sealing webs at the edges of the rotor vanes.

In another advantageous construction, the material openings are constructed on the vane ends that are formed in a peripheral direction with a width that varies in the radial direction. This causes a material thickness that changes along the peripheral direction, wherein the elastic deformability can be selectively adapted to the requirements. In particular, a locally deformable or bending area is created for the sealing webs.

Advantageously, the sealing webs adjacent to the material openings at the vane ends are constructed with a freely moving web end. Because the web is connected rigidly to the vane end only on one side, the freely moving end can be deformed elastically in an especially easy way during operation. This construction also allows the width of the radial leakage gap to be influenced along the peripheral direction.

Other possibilities for the construction of the vane ends or the sealing webs of a rotor are also basically conceivable. The material openings and the material thicknesses can be matched to each other with respect to the centrifugal forces acting during operation, in order to guarantee problem-free functioning of the camshaft adjuster.

Preferably, the rotor base body is produced as one piece with the rotor vanes with a powder-metallurgical method. The one-piece production is especially advantageous, because it allows the production process to be simplified. The invention allows the rotor base body and rotor vanes to be produced as one component in a common processing step while creating the sealing functionality. An assembly of individual parts is eliminated. In contrast to a multiple-component production, possible leakage points at the contact point of the rotor base body with the rotor vanes are also prevented.

As the powder-metallurgical method, in particular, a sintering method is preferred. A sintering method can achieve high precision that is advantageous for the adjustment of the radial leakage gaps. Because sintered components have high dimensional accuracy, additional expensive post-processing steps for the rotor can be eliminated. A sintering process also offers the ability to use an automated processing sequence, wherein increased processing costs and additional processing effort can be avoided. The sintering material also affects the strength and the weight of the rotor, wherein the elastic deformation of the sealing webs can also be influenced. Accordingly, the selection of the sintering material can also influence the remaining width of the radial leakage gaps during the operation of the camshaft adjuster.

The forces that are active during operation must be considered in the design of the sealing webs, in order to guarantee a reliable functioning of the camshaft adjuster. Here, the sealing webs can have a wall thickness that gives the desired sealing effect with a sufficiently high strength. The wall thickness is here dependent in the peripheral direction on the shape of the material openings formed in the vane ends. For example, the wall thickness for a dumbbell-shaped material opening is smaller at the outer ends of the sealing webs, in the region of the larger openings, than in the area located in-between.

The second object of the invention is solved according to the invention by a camshaft adjuster for an internal combustion engine comprising a stator and also a rotor that is arranged within the stator and can rotate relative to this stator according to the constructions noted above. Here it is provided that the sealing webs of the vane ends extending outward in the radial direction form a sealing effect relative to the inner lateral surface of the stator.

As already mentioned above, the sealing effect of the sealing webs involves the centrifugal forces that are active during the operation of the camshaft adjuster. The sealing webs are here deformed elastically in the radial direction and pressed against the inner lateral surface of the stator. In this way, the radial leakage gap between the rotor vanes and the inner wall of the stator is reduced. The sealing effect achieved here allows the operation of a camshaft adjuster without an additional sealing element.

The stator typically has a number of webs that extend inward in the radial direction, with pressure chambers being formed between these webs. The vanes of the rotor extending outward in the radial direction can be positioned in these pressure chambers, so that the hydraulic areas for charging with hydraulic fluid are formed on the outsides of the vanes. For charging, the rotor has, in particular, oil channels in its base body through which oil can be pumped into the pressure chambers of the stator or the camshaft adjuster. Vane stop surfaces on which the vanes of a rotor can contact in the installed state can be formed on the webs of the stator.

The camshaft adjuster is typically also formed with a sealing cover and with a locking cover in addition to the stator and the rotor. The locking cover is advantageously connected to the stator and bounds the pressure chambers on the side of the camshaft. It is used for sealing the pressure space from the outside, prevents an uncontrolled discharge of hydraulic fluid, and thus reduces external leakage. A connecting element that is used for locking the stator and rotor in a given position is typically formed in the locking cover.

During operation, the gap dimensions decrease as a function of the centrifugal forces acting on the rotor or on the vane ends. The dimensions or the width of the radial leakage gaps is here, for example, dependent on the component thickness of the rotor and on the wall thickness of the sealing webs. These webs and the material openings can be matched to each other, so that a durable design of the elastic or elastically deformable sealing webs is possible.

Other advantageous constructions can be found in the dependent claims that are directed toward the rotor and can be transferred analogously to the camshaft adjuster.

BRIEF DESCRIPTION OF THE DRAWINGS

Embodiments of the invention are explained in more detail below in a drawing. Shown herein are FIGS. 1 to 3, each of which is a cross section of a rotor with rotor vanes that are constructed differently, and FIG. 4, which is a cross section of a camshaft adjuster with a rotor according to FIG. 1 in the installed state.

DETAILED DESCRIPTION OF THE PREFERRED EMBODIMENTS

Figure 1:
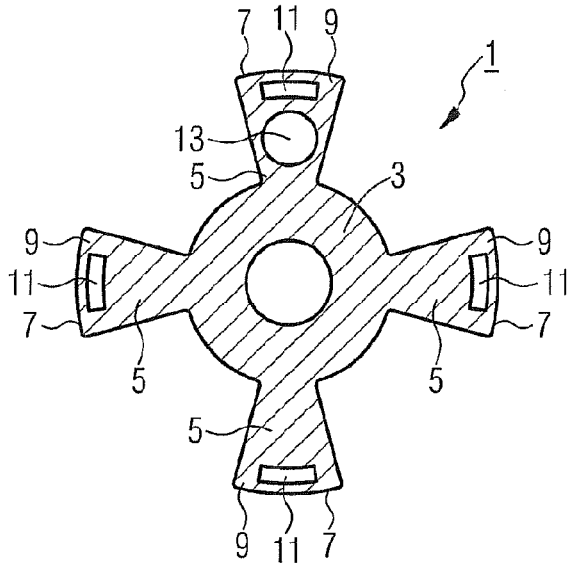
Figure 4:
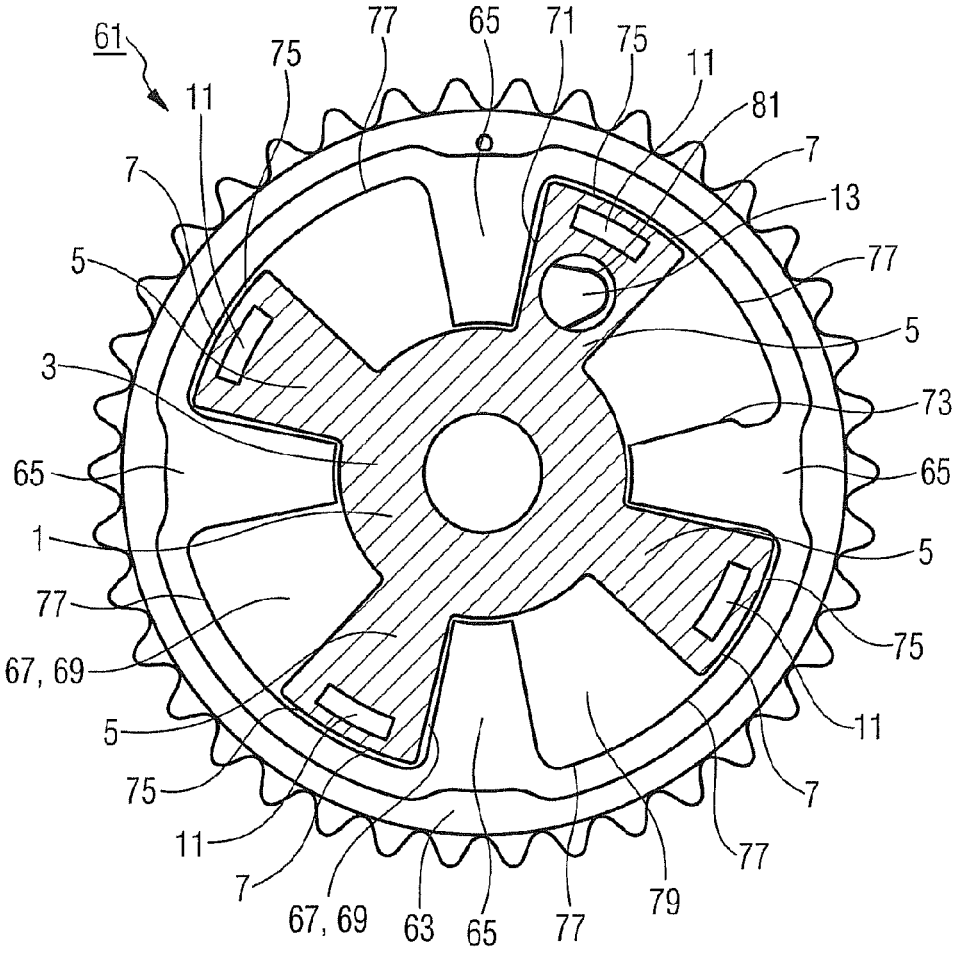

FIG. 1 shows a rotor 1 for a camshaft adjuster in a cross section. The rotor 1 has a rotor base body 3 with four rotor vanes 5 extending outward in the radial direction. In the installed state, when the rotor 1 is positioned in a stator, the rotor vanes 5 are used for dividing each pressure chamber of a camshaft adjuster into two adjacent hydraulic areas. A camshaft adjuster is shown in FIG. 4.

The rotor base body 3 and the rotor vanes 5 are produced as one piece by a sintering method from a metallic material. In contrast to a two-part production in which the rotor vanes 5 are held, for example, in grooves in the rotor base body 3, possible locations for leakage points are minimized by the single-part design. Furthermore, the sintering process offers the ability to use an automated processing sequence and is thus cost-effective and easy to perform. Due to the dimensional accuracy of the method, the rotor 1 can be produced so that the radial leakage gaps between the vane ends and the inner lateral surface of a stator in the installed state are sufficiently small.

The rotor vanes 5 have vane ends 7 that are constructed for reducing the leakage in a camshaft adjuster. For this purpose, the vane ends 7 are shaped into sealing webs 9 that can deform elastically outward in the radial direction. They are made from the same material as the rotor vanes 5 and are produced during the sintering process as part of the rotor vanes 5 or as part of the rotor 1.

The elastic deformability of the sealing webs 9 is caused by the material openings 11 formed in the vane ends 7. The material openings 11 are bounded in the radial direction by the sealing webs 9 and have a constant radial gap dimension in the peripheral direction. Here, during operation, a constant sealing effect is realized across the periphery. In the middle of the sealing webs 9, the highest sealing effect is achieved, because the elastic deformation of the vane ends 7 is most pronounced at this point. The material openings 11 are formed by the production method of the rotor 1 directly in the rotor vanes 5.

Overall, the internal leakage can be reduced without the use of separate sealing elements.

In addition, a locking borehole 13 for locking with a stator in the installed state is included in a rotor vane 5. For this purpose, for example, a piston can engage through the locking borehole 13 in a connecting element in the base of a locking cover, so that the rotor 1 and a stator can be held in an optimum position especially for the start or idling of an internal combustion engine. The connecting element for locking is shown in FIG. 4.

Figure 2:
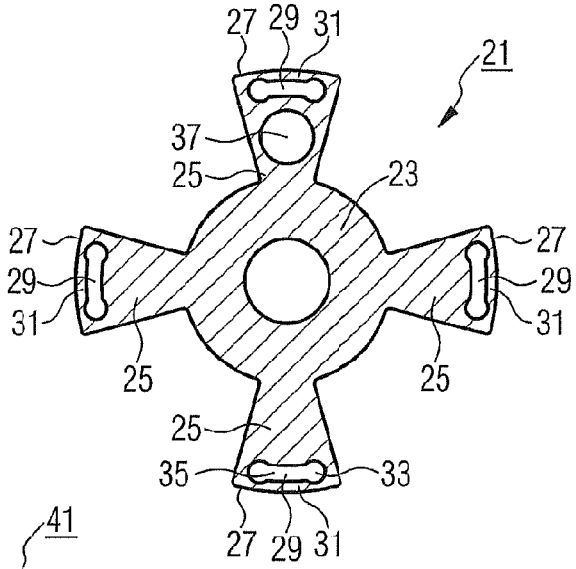

A rotor 21 for a camshaft adjuster is also shown in FIG. 2 in a cross section. The rotor 21 also has a rotor base body 23 with four rotor vanes 25 that extend outward in the radial direction and divide the pressure chambers of a camshaft adjuster into hydraulic areas in the installed state. The rotor 21 is also produced as one piece from a metallic material by means of a sintering process.

Material openings 29 that are bounded outward in the radial direction by sealing webs 31 are also formed in the vane ends 27. The material openings 29 are constructed with a radial gap dimension that changes in the peripheral direction in the shape of a dumbbell. Accordingly, the sealing webs 31 have a wall thickness that changes along the peripheral direction. Its designation 33, 35 is shown only at a material opening 29 for the sake of clarity. A deformation point for the elastic movement of the sealing web 31 is realized outward selectively at the circular openings 33.

According to FIG. 1, a locking borehole 37 for locking with a stator in the installed state is also included by a rotor vane 25 of the rotor 21.

Figure 3:
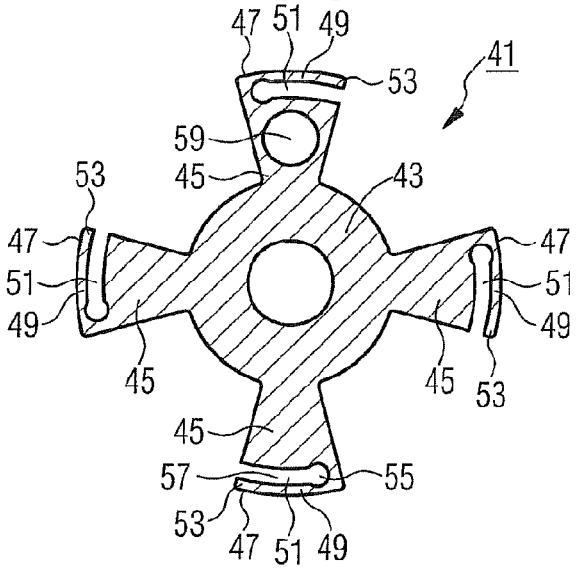

The rotor 41 shown in FIG. 3 also in a cross section with a rotor base body 43 and four rotor vanes 45 arranged on this base body is produced as one piece by a sintering process according to FIGS. 1 and 2. The rotor vanes 45 extending outward in the radial direction have sealing webs 49 at the vane ends 47.

These sealing webs 49 bound the material openings 51 formed in the vane ends 47 in the radial direction. The material openings 51 are constructed in the peripheral direction with a changing radial gap dimension and open toward one of the vane contact surfaces 71, 73. The vane ends 47 are weakened by the material openings 51 on one side to form attached sealing webs 49. Each of the free web ends 53 of the sealing webs 49 is pressed outward in the radial direction by the centrifugal force acting on the rotor 41 during operation.

The wall thickness at the position of the circular opening 57 is increased relative to the position of the adjacent web-shaped opening 57. Its designation 55, 57 is shown only at one material opening 51 for the sake of clarity as in FIG. 2.

A locking borehole 59 that is used in the installed state of the locking of the rotor and stator in a desired position is also formed in FIG. 3 in a rotor vane 45 of the rotor 41.

FIG. 4 shows a camshaft adjuster 61 with a rotor 1 according to FIG. 1 inserted in a stator 63 in a top view. The rotor 1 has a rotor base body 3 with four rotor vanes 5 extending radially outward. The rotor base body 3 and rotor vanes 5 are produced as one part by means of sintering from a metallic material. For the description of the rotor 1, at this point reference is made to FIG. 1.

The stator 63 has webs 65 that extend radially inward and between each of which a rotor vane 5 of the rotor 1 is positioned. The rotor vanes 5 divide the pressure chambers 67 formed in the stator 63 into two hydraulic areas 69 that are located to the right and left, respectively, of the rotor vanes 5. This is made visible in FIG. 4 for the sake of clarity only for one pressure chamber 67 or two hydraulic areas 69.

A vane stop surface 71, 73 is formed on each of two webs 65 and these stop surfaces stop the rotor vanes 5 in a certain position by means of contact. Both vane stop surfaces 71, 73 are located within a pressure chamber 67 or each in a hydraulic area 69, so that the rotor vane 5 can contact both sides of the pressure chamber 67.

FIG. 4 shows the camshaft adjuster 61 in a standstill state, wherein the vane ends 7 extending radially outward in the rotor vane 5 or the sealing webs 9 do not directly contact the inner periphery of the stator 63 with their outer periphery. Accordingly, the radial leakage gaps 75 that are formed between the inner lateral surface 77 of the stator 63 and the vane ends are clearly visible.

During operation, that is, for the rotation of the rotor 1 within the stator 63, the leakage gaps 75 are made smaller while increasing the sealing effect between the hydraulic areas 69. The sealing webs 9 are deformed radially in the direction of the inner lateral surface 77 of the stator 63, so that the radial gap dimensions between the rotor 1 and the stator 63 are made smaller. In this way, the leakage is reduced and a sealing of the hydraulic areas 69 from each other can be achieved without the use of separate sealing elements.

The rotor 1 further has oil channels for charging the pressure chambers 67 with oil, wherein these channels are not visible, because they are located in the interior of the body of the rotor 1.

In one rotor vane 5, a locking borehole 13 is formed through which a not-shown piston can engage in the connecting element 81 formed in the locking cover 79. In this way, the rotor 1 can be held in a designated position. In the unlocked state, the piston is raised and the rotor 1 can move in a certain adjustment angle. The locking cover 79 is connected to the stator 63 and bounds the pressure chambers 67 on the side of the camshaft. In this way, the locking cover 79 is also used for reducing the external leakage of the camshaft adjuster 61.

LIST OF REFERENCE NUMBERS

1 Rotor
3 Rotor base body
5 Rotor vane
7 Vane end
9 Sealing web
11 Material opening
13 Locking borehole
21 Rotor
23 Rotor base body
25 Rotor vane
27 Vane end
29 Material opening
31 Sealing web
33 Opening
35 Opening
37 Locking borehole
41 Rotor
43 Rotor base body
45 Rotor vane
47 Vane end
49 Sealing web
51 Material opening
53 Web end
55 Opening
57 Opening
59 Locking borehole
61 Camshaft adjuster
63 Stator
65 Webs
67 Pressure chambers
69 Hydraulic areas
71 Vane stop surface
73 Vane stop surface
75 Radial leakage gap
77 Inner lateral surface
79 Locking cover
81 Connecting element

The invention claimed is:

1. A rotor for a camshaft adjuster, comprising a rotor base body having a number of rotor vanes that are arranged on the rotor base body and extend radially outward and each of which has a vane end, the vane ends of the rotor vanes are shaped into sealing webs that can deform elastically outward in a radial direction for reduction of leakage.

2. The rotor according to claim 1, wherein material openings are formed in the vane ends to form the sealing webs.

3. The rotor according to claim 2, wherein the material openings in the vane ends are bounded in the radial direction by the sealing webs.

4. The rotor according to claim 3, wherein the sealing webs bounding the material openings in the vane ends are formed with a freely moving web end.

5. The rotor according to claim 2, wherein the material openings in the vane ends are formed along a peripheral direction with a constant radial width.

6. The rotor according to claim 2, wherein the material openings in the vane ends are formed in a peripheral direction with a width that varies in the radial direction.

7. The rotor according to claim 1, wherein the rotor base body is produced as one piece with the rotor vanes from the powdered metal.

8. The camshaft adjuster for an internal combustion engine, comprising a stator and a rotor that is constructed according to claim 1, wherein the rotor is arranged within the stator and can rotate relative to the stator, the sealing webs of the vane ends that extend radially outward are sealed relative to an inner lateral surface of the stator.

* * * * *